US009418593B2

(12) United States Patent
Kim

(10) Patent No.: US 9,418,593 B2
(45) Date of Patent: Aug. 16, 2016

(54) ORGANIC LIGHT EMITTING DISPLAY DEVICE AND DRIVING METHOD THEREOF

(71) Applicant: Samsung Display Co., Ltd., Yongin (KR)

(72) Inventor: Cheol-Min Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 11 days.

(21) Appl. No.: 14/202,945

(22) Filed: Mar. 10, 2014

(65) Prior Publication Data

US 2014/0375533 A1 Dec. 25, 2014

(30) Foreign Application Priority Data

Jun. 19, 2013 (KR) ..... 10-2013-0070206

(51) Int. Cl.
*G09G 3/30* (2006.01)
*G09G 3/32* (2016.01)

(52) U.S. Cl.
CPC ..... *G09G 3/3233* (2013.01); *G09G 2300/0861* (2013.01); *G09G 2320/0295* (2013.01)

(58) Field of Classification Search
USPC ..... 345/78, 76, 52, 82, 87; 327/533; 315/169.1
See application file for complete search history.

(56) References Cited

U.S. PATENT DOCUMENTS 7,459,959 B2 * 12/2008 Rader ..... G09G 3/342 327/533
8,269,695 B2 * 9/2012 Kasai ..... G09G 3/3233 315/169.1
2004/0233144 A1 * 11/2004 Rader ..... G09G 3/342 345/82
2008/0001870 A1 * 1/2008 Lee ..... G09G 3/3655 345/87
2008/0068316 A1 * 3/2008 Maekawa ..... G09G 3/3655 345/87
2011/0084955 A1 4/2011 Kim
2011/0227505 A1 9/2011 Park et al.
2013/0141316 A1 * 6/2013 Lee et al. ..... 345/76

FOREIGN PATENT DOCUMENTS

KR 10-2011-0039773 4/2011
KR 10-2011-0104705 9/2011

* cited by examiner

*Primary Examiner* — Thuy Pardo
(74) *Attorney, Agent, or Firm* — H.C. Park & Associates, PLC

(57) ABSTRACT

An organic light emitting display including pixels, a scan driver, a data driver, a control line driver, and a compensation unit. The pixels are positioned in an area defined by data lines, scan lines, and control lines, and each includes an organic light emitting diode. The scan driver drives the scan lines. The data driver drives the data lines. The control line driver drives the control lines. The compensation unit extracts threshold voltage information of a driving transistor included in each pixel during a sensing period. In the organic light emitting display, the compensation unit supplies a preset voltage to a gate electrode of the driving transistor so that a second current flows during the sensing period, and supplies a reference voltage to a drain electrode of the driving transistor during the period in which the second current flows.

8 Claims, 6 Drawing Sheets

ORGANIC LIGHT EMITTING DISPLAY DEVICE AND DRIVING METHOD THEREOF

CROSS-REFERENCE TO RELATED APPLICATION

This application claims priority from and the benefit of Korean Patent Application No. 10-2013-0070206, filed on Jun. 19, 2013, which is hereby incorporated by reference for all purposes as if fully set forth herein.

BACKGROUND

1. Field

Exemplary embodiments of the present invention relate to an organic light emitting display device and a driving method thereof.

2. Discussion of the Background

Flat panel display devices currently in use include a liquid crystal display, a field emission display, a plasma display panel, an organic light emitting display, and the like.

Among these flat panel displays, the organic light emitting display displays images using organic light emitting diodes that emit light through recombination of electrons and holes. The organic light emitting display has high speed and a fast response time, and is driven with low power consumption. However, the amount of current flowing through the organic light emitting diode depends on a variation in threshold voltage of the driving transistor included in each pixel, which may result in undesirable variations in display quality. That is, the characteristic of the driving transistor may be changed depending on manufacturing process variables of the driving transistor included in each pixel. The manufacturing of the organic light emitting display so that all the transistors have the same characteristics is practically impossible in the current displays. Accordingly, variations in threshold voltages of the driving transistor may occur.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide an organic light emitting display and a driving method thereof, which can display an image with a desired luminance, regardless of the threshold voltage of a driving transistor.

Exemplary embodiments of the present invention also provide an organic light emitting display and a driving method thereof, which can extract threshold voltage information of a driving transistor, which reflect characteristics of an organic light emitting diode.

Additional features of the invention will be set forth in the description which follows, and in part will become apparent from the description, or may be learned from practice of the invention.

An exemplary embodiment of the present invention discloses an organic light emitting display, including: pixels positioned in an area defined by data lines, scan lines, and control lines, the pixels each including an organic light emitting diode; a scan driver configured to drive the scan lines; a data driver configured to drive the data lines; a control line driver configured to drive the control lines; and a compensation unit configured to extract threshold voltage information of a driving transistor included in each pixel during a sensing period. The compensation unit supplies a preset voltage to a gate electrode of the driving transistor so that a first current flows during the sensing period, and supplies a reference voltage to a drain electrode of the driving transistor during the period in which the first current flows.

An exemplary embodiment of the present invention also discloses a method of driving an organic light emitting display, the method including: applying a reference voltage to a drain electrode of a driving transistor so that a first current flows through an organic light emitting diode coupled to the drain electrode of the driving transistor; applying a preset voltage to a gate electrode of the driving transistor; and applying the reference voltage to the drain electrode of the driving transistor while measuring a second current flowing through the driving transistor and corresponding to the preset voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
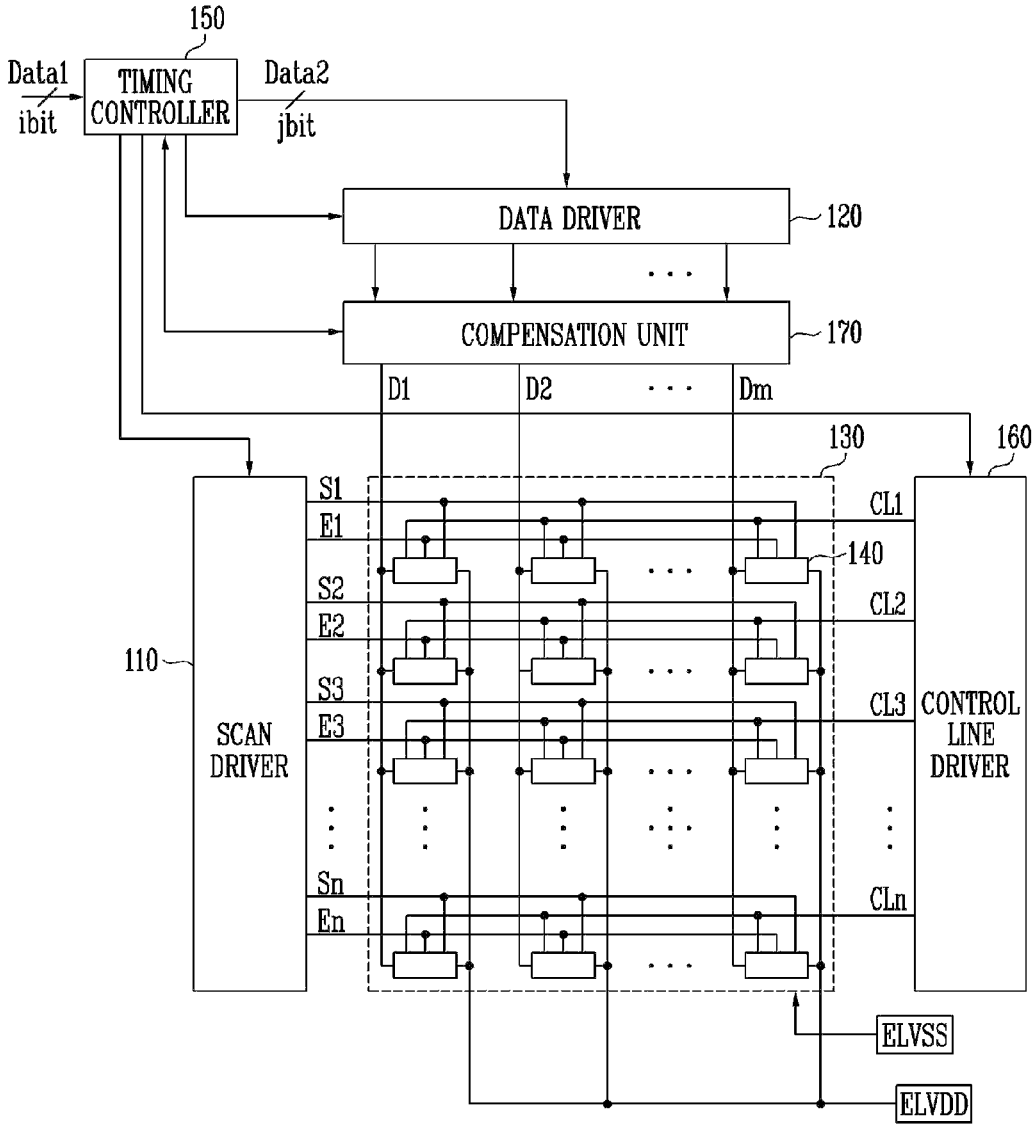
FIG. 1 is a diagram illustrating an organic light emitting display according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ)

FIG. 1 is a diagram illustrating an organic light emitting display according to an exemplary embodiment of the present invention.

Referring to FIG. 1, the organic light emitting display includes a pixel unit 130 including pixels 140 positioned at intersection points of scan lines S1 to Sn and data lines D1 to Dm, a scan driver 110 configured to drive the scan lines S1 to Sn and emission control lines E1 to En, and a control line driver 160 configured to drive control lines CL1 to CLn.

The organic light emitting display further includes a data driver 120 configured to supply a data signal to the data lines D1 to Dm, a compensation unit 170 configured to extract, from each pixel 140, degradation information of an organic light emitting diode and/or threshold voltage information of a driving transistor, and a timing controller 150 configured to control the drivers 110, 120 and 160 and the compensation unit 170.

The pixel unit 130 includes the pixels 140 positioned in an area defined by the scan lines S1 to Sn, the data lines D1 to Dm, and the control lines CL1 to CLn. The pixels 140 receive power from first and second power sources ELVDD and ELVSS supplied from outside the organic light emitting display. Each pixel 140 controls the amount of current supplied from the first power source ELVDD to the second power source ELVSS via an organic light emitting diode (to be described later), the amount of current corresponding to a data signal.

The scan driver 110 supplies a scan signal to the scan lines S1 to Sn, and supplies an emission control signal to the emission control lines E1 to En, under the control of the timing controller 150. For example, the scan driver 110 progressively supplies a scan signal to the scan lines S1 to Sn, and progressively supplies an emission control signal to the emission control lines E1 to En, under the control of the timing controller 150. Here, the scan signal is set to a voltage at which transistors included in the pixels 140 can be turned on, and the emission control signal is set to a voltage at which the transistors included in the pixels 140 can be turned off.

The control line driver 160 supplies a control signal to the control lines CL1 to CLn under the control of the timing controller 150. For example, the control line driver 160 may progressively supply a control signal to the control lines CL1 to CLn during a period in which threshold voltage information is extracted from each pixel 140.

The data driver 120 generates data signals, using second data Data2 supplied from the timing controller 150, and supplies the generated data signals to the data lines D1 to Dm.

The compensation unit 170 extracts at least one of degradation information and threshold voltage information from each pixel 140. Subsequently, it is assumed that, for convenience of illustration, the threshold voltage information is extracted from the compensation unit 170. During a sensing period, the compensation unit 170 is coupled to pixels 140 selected by a control signal or scan signal transmitted via the data lines D1 to Dm, and extracts threshold voltage information of the driving transistor from each pixel 140. Here, the compensation unit is 170 extracts the threshold voltage information in consideration of characteristics of the organic light emitting diode (to be described later). Additionally, the compensation unit 170 controls the data lines D1 to Dm to be coupled to the data driver 120 during a driving period in which an image is displayed in the pixel unit 130.

The timing controller 150 controls the scan driver 110, the data driver 120, the control line driver 160, and the compensation unit 170. The timing controller 150 generates a second data Data2 by converting the bit value of a first data Data1 that is input from outside the organic light emitting display, so that the threshold voltage of the driving transistor can be compensated by an amount corresponding to the threshold voltage information supplied from the compensation unit 170. Here, the first data Data1 is set to i (i is a natural number) bit(s), and the second data Data2 is set to a j (j is a natural number greater than i) bits.

Figure 2:
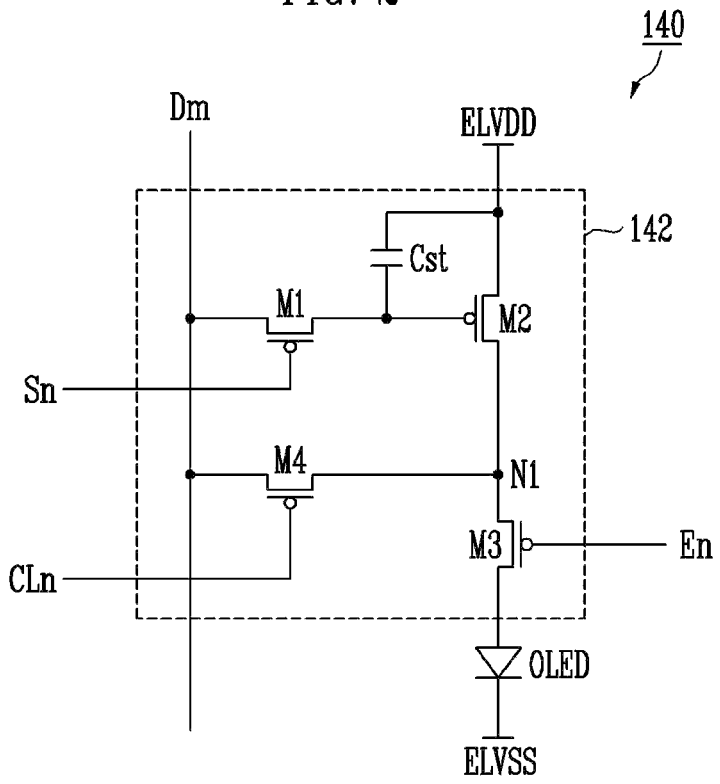
FIG. 2 is a circuit diagram illustrating a pixel according to an exemplary embodiment of the present invention.

FIG. 2 is a circuit diagram illustrating a pixel according to an exemplary embodiment of the present invention. For convenience of illustration, an exemplary pixel coupled to an n-th scan line Sn and an m-th data line Dm is shown in FIG. 2.

Referring to FIG. 2, the pixel 140 includes an organic light emitting diode OLED and a pixel circuit 142 configured to supply current to the organic light emitting diode OLED.

An anode electrode of the organic light emitting diode OLED is connected to the pixel circuit 142, and a cathode electrode of the organic light emitting diode OLED is connected to the second power source ELVSS. The organic light emitting diode OLED generates light with a luminance corresponding to current supplied from the pixel circuit 142.

The pixel circuit 142 supplies a current to the organic light emitting diode OLED corresponding to a data signal during a driving period. The pixel circuit 142 provides threshold voltage information of a driving transistor M2 during a sensing period, where the pixel circuit is 142 includes four transistors M1, M2, M3, and M4, and a storage capacitor Cst.

A gate electrode of the first transistor M1 is connected to the scan line Sn, and a first electrode of the first transistor M1 is connected to the data line Dm. A second electrode of the first transistor M1 is connected to a gate electrode of the second transistor M2. The first transistor M1 is turned on when a scan signal is supplied to the scan line Sn.

The gate electrode of the second transistor M2 (i.e., the driving transistor) is connected to the second electrode of the first transistor M1, and a first electrode of the second transistor M2 is connected to the first power source ELVDD. A second electrode of the second transistor M2 is connected to a first node N1. The second transistor M2 controls the amount of current flowing from the first power source ELVDD to the first node N1, the amount of current corresponding to a voltage applied to the gate electrode of the second transistor M2, i.e., a voltage stored in the storage capacitor Cst.

A first electrode of the third transistor M3 is connected to the first node N1, and a second electrode of the third transistor M3 is connected to the anode electrode of the organic light emitting diode OLED. A gate electrode of the third transistor M3 is connected to an emission control line En. The third transistor M3 is turned off when an emission control signal is supplied to the emission control line En, and is turned on when the emission control signal is not supplied.

A gate electrode of the fourth transistor M4 is connected to a control line CLn, and a first electrode of the fourth transistor M4 is connected to the first node N1. A second electrode of the fourth transistor M4 is connected to the data line Dm. The fourth transistor M4 is turned on when a control signal is supplied to the control line CLn, and is turned off when the control signal is not supplied.

The structure of the pixel 140 of the present invention is not limited to what is illustrated in FIG. 2. The pixel 140 may be used in other configurations including the fourth transistor M4 so that the threshold voltage information can be extracted. For example, the pixel 140 may be configured as any one of circuits currently known in the art.

Figure 3:
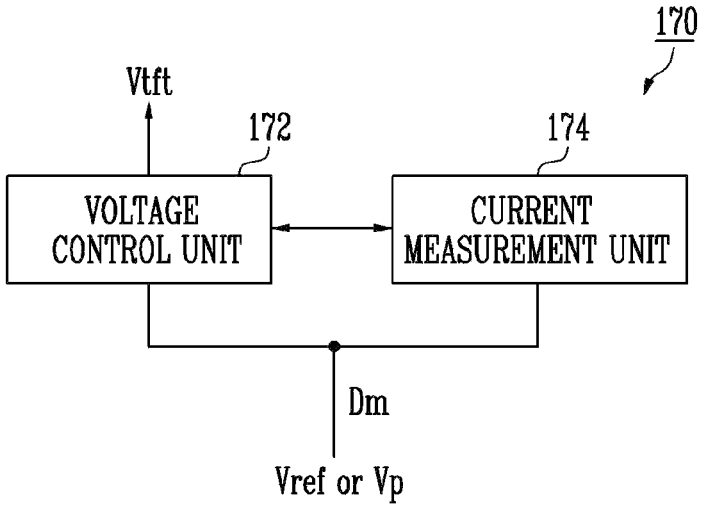
FIG. 3 is an exemplary embodiment of the present invention illustrating a channel of a compensation unit.

FIG. 3 illustrates an exemplary embodiment of a channel of the compensation unit 170.

Referring to FIG. 3, a voltage control unit 172 and a current measurement unit 174 are provided in each channel of the compensation unit 170. The voltage control unit 172 applies a preset voltage Vp, which may equal a reference voltage Vref, to the data line Dm during the sensing period. The current measurement unit 174 measures the amount of current flowing in the pixel 140 corresponding to the preset voltage supplied from the voltage control unit 172.

For convenience of illustration, only a component configured to extract threshold voltage information has been illustrated in FIG. 3, but the present invention is not limited thereto. For example, the compensation unit 170 may additionally include a component configured to extract degradation information of an organic light emitting diode, a component configured to selectively couple the data lines D1 to Dm to the data driver 120, etc.

Figure 4A:
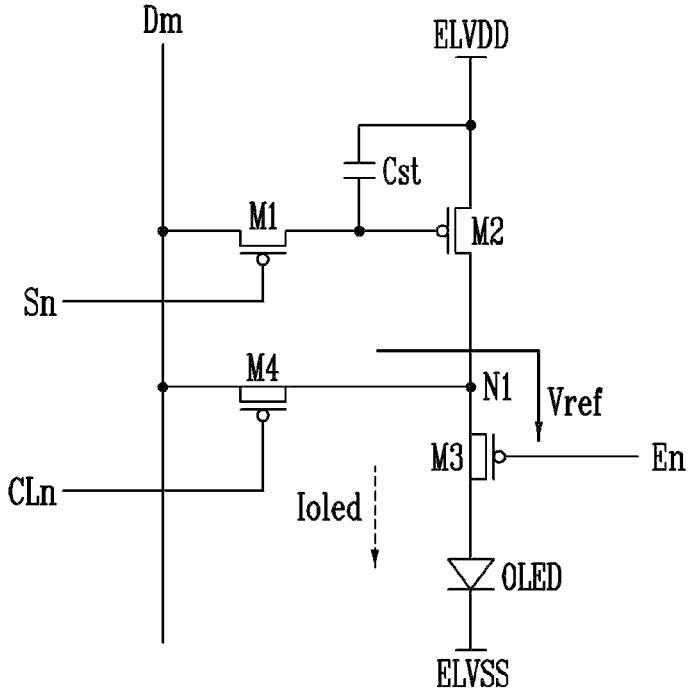
FIG. 4A, FIG. 4B, and FIG. 4C are diagrams illustrating driving waveforms supplied during a sensing period according to an exemplary embodiment of the present invention.
Figure 4A:
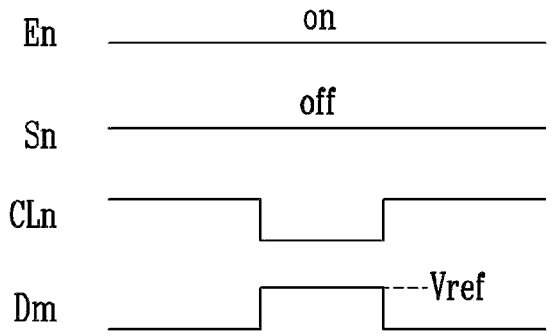
Figure 4B:
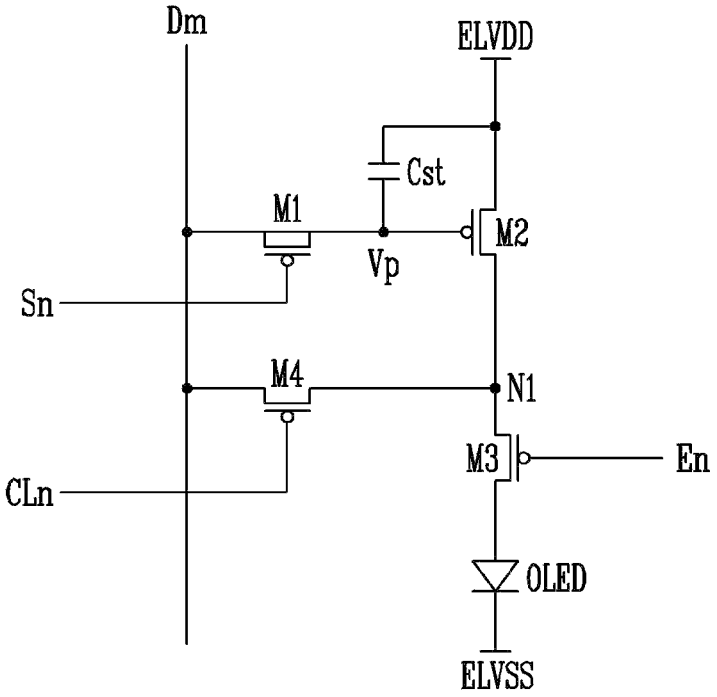
Figure 4B:
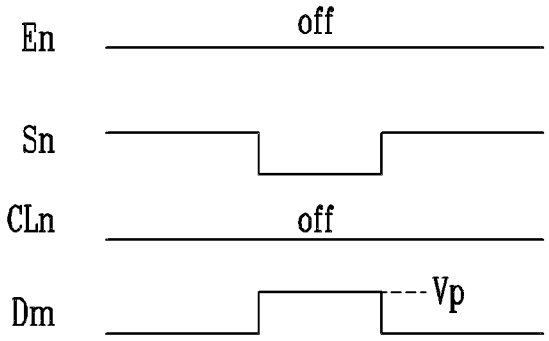
Figure 4C:
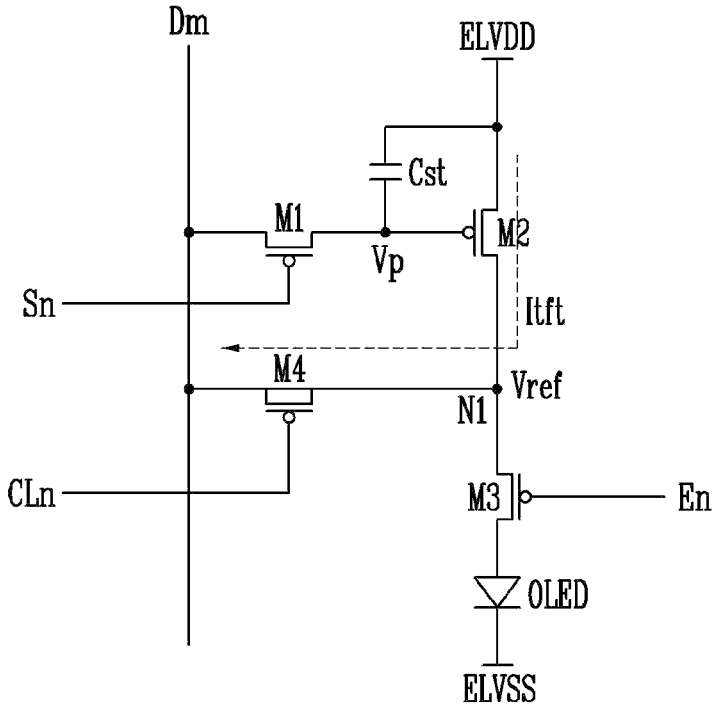
Figure 4C:
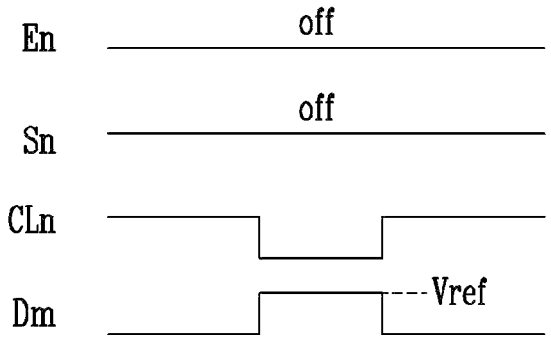

FIGS. 4A to 4C are diagrams illustrating an exemplary embodiment of driving waveforms supplied during the sensing period.

Referring to FIGS. 4A to 4C, a control signal is first supplied to the control line CLn, as shown in FIG. 4A, so that the fourth transistor M4 is turned on. If the fourth transistor M4 is turned on, the data line Dm and the first node N1 are electrically coupled to each other. Then, the reference voltage Vref supplied from the voltage control unit 172 via the data line Dm is supplied to the first node N1.

The emission control signal is supplied to the emission control line En during the period in which the reference voltage Vref is supplied and, hence, the third transistor M3 is set in a turn-on state. Then, a first current Ioled flows through the organic light emitting diode OLED, corresponding to the reference voltage Vref supplied to the first node N1. In this case, the current measurement unit 174 measures the current value of the first current Ioled, and temporarily stores the measured value.

Subsequently, as shown in FIG. 4B, a scan signal is supplied to the scan line Sn, and simultaneously, a preset voltage Vp is supplied to the data line Dm. If the scan signal is supplied to the scan line Sn, the first transistor M1 is turned on. If the first transistor M1 is turned on, the preset voltage Vp from the data line Dm is supplied to the gate electrode of the second transistor M2. Then, a voltage corresponding to the preset voltage Vp is stored in the storage capacitor Cst. For example, the preset voltage Vp may be set as a voltage equal to the reference voltage Vref.

After the voltage corresponding to the preset voltage Vp is stored in the storage capacitor Cst, as shown in FIG. 4C, the control signal is supplied to the control line CLn and, simultaneously, the reference voltage Vref is supplied to the data line Dm. Then, the fourth transistor M4 is turned on, and the reference voltage Vref is supplied to the first node N1.

If the fourth transistor M4 is turned on, a second current Itft from the second transistor M2 is supplied to the current measurement unit 174 via the data line Dm, corresponding to the preset voltage Vp. Then, the current measurement unit 174 compares the amount of the first current Ioled with that of the second current Itft, and supplies, to the voltage control unit 172, a control signal corresponding to the compared amount of current.

The voltage control unit 172 receiving the control signal controls the preset voltage Vp so that the second current Itft can be equal to the first current Ioled. The voltage control unit 172 and the current measurement unit 174 repeat the procedure of FIGS. 4B and 4C so that the first current Ioled and the second current Itft can be equal to each other.

Subsequently, if it is determined that the first current Ioled and the second current Itft have the same current value, the voltage control unit 172 transmits the preset voltage Vp as threshold voltage information Vtft to the timing controller 150. Here, the threshold voltage information Vtft is a voltage set so that the second current Itft has the same current value as the first current Ioled. The threshold voltage information Vtft includes threshold voltage information of the driving transistor M2.

The timing controller 150 receiving the threshold voltage information Vtft transmitted from the voltage control unit 172 converts the threshold voltage information Vtft into a digital value, and stores the converted digital value. Subsequently, the timing controller 150 generates the second data Data2 by changing bits of the first data Data1 so that the threshold voltage information Vtft of the driving transistor M2 can be compensated corresponding to the digital value.

In the present invention, the threshold voltage information is extracted from each pixel 140 while repeating the procedure described above during the sensing period. Here, the threshold voltage information Vtft of the pixels 140 may be differently set corresponding to the threshold voltage of the driving transistor M2 included in each pixel 140.

The second electrode (i.e., the drain electrode) of the second transistor M2 maintains the same voltage, i.e., the reference voltage Vref, during the period in which the first current Ioled flows through the organic light emitting diode OLED and the period in which the second current Itft is extracted. Then, the operation points during the sensing and driving periods correspond to each other, thereby extracting exact threshold voltage information.

Specifically, the current supplied from the driving transistor M2 during the period in which the pixel 140 emits light is supplied to the organic light emitting diode OLED via the third transistor M3. In this case, the current Itft supplied from the driving transistor M2 and the current Ioled flowing through the organic light emitting diode OLED are set equal to each other.

Figure 5:
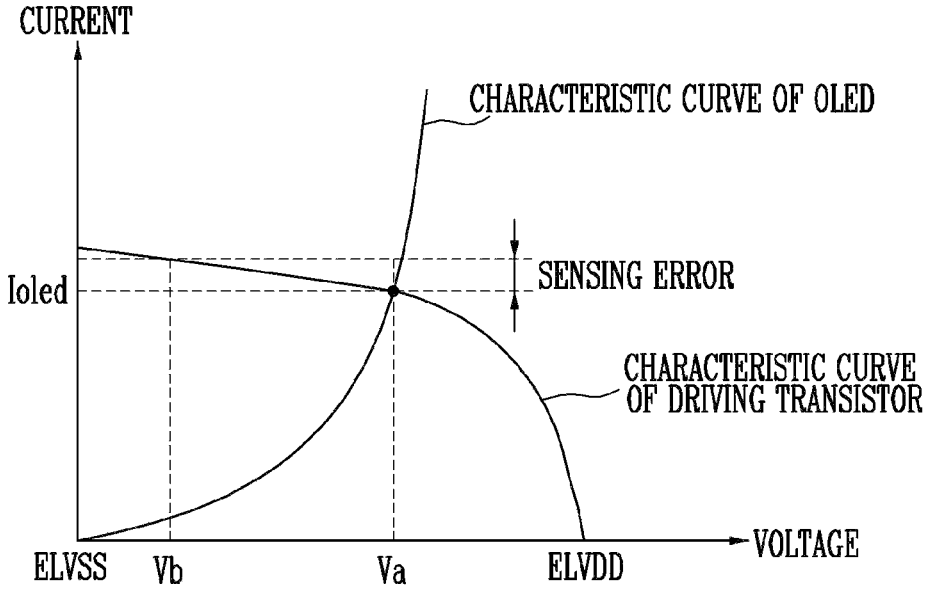
FIG. 5 is a graph illustrating an operation point corresponding to characteristics of a driving transistor and an organic light emitting diode, according to an exemplary embodiment of the present invention.

In this case, the first node N1 is set to the voltage of a first operation point Va, as shown in FIG. 5, corresponding to the current Itft supplied to the driving transistor M2 and the current Ioled flowing through the organic light emitting diode OLED. That is, if the first node N1 is set to the same voltage when the current Itft is supplied from the driving transistor M2 and when the current Ioled is supplied to the organic light emitting diode OLED, the operation points correspond to each other, thereby extracting exact threshold voltage information without any difference in current.

For example, in a case where the voltage at the first node N1 when the current Itft is supplied from the driving transistor M2 is different from that at the first node N1 when the current Ioled is supplied to the organic light emitting diode OLED, the operation points do not correspond to each other and, therefore, a current difference occurs. In other words, if the voltage of a second operation point Vb is applied when the current Itft is supplied from the driving transistor M2, a sensing error occurs. Accordingly, the reliability of the threshold voltage information may be lowered.

Meanwhile, although it has been described in this exemplary embodiment that the threshold voltage information is extracted for each pixel 140, the present invention is not limited thereto. For example, the threshold voltage information may be extracted for each block including at least one pixel.

Additionally, although it has been described in the present invention that the transistors are shown as PMOS transistors for convenience of illustration, the present invention is not limited thereto. For example, the transistors may be formed as NMOS transistors.

In the present invention, the organic light emitting diode OLED generates light of red, green, or blue, corresponding to the amount of current supplied from the driving transistor. However, the present invention is not limited thereto. For example, the organic light emitting diode OLED may generate white light, corresponding to the amount of the current supplied from the driving transistor. In this case, a color image is implemented using a separate color filter or the like.

By way of summation and review, an organic light emitting display includes pixels arranged in a matrix form at intersection points of data lines, scan lines, and power lines. Each pixel generally includes an organic light emitting diode, two or more transistors including a driving transistor, and one or more capacitors.

In the organic light emitting display and the driving method thereof according to the exemplary embodiments, threshold voltage information of the driving transistor is extracted during the sensing period, and the bits of data are controlled using the extracted threshold voltage information, thereby displaying an image with uniform luminance regardless of the threshold voltage of the driving transistor. Further, according to various embodiments, the operation point when the threshold voltage is extracted corresponds to when the pixel is driven to emit light. Accordingly, it is possible to extract exact threshold voltage information.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit or scope of the present invention. Thus, it is intended that the present invention cover the modifications and variations of this invention provided they come within the scope of the appended claims and their equivalents.

What is claimed is:

1. An organic light emitting display device, comprising:

pixels arranged in an area defined by data lines, scan lines, and control lines, each pixel comprising an organic light emitting diode and a driving transistor, the driving transistor comprising a gate electrode and a drain electrode;

a scan driver configured to drive the scan lines;

a data driver configured to drive the data lines;

a control line driver configured to drive the control lines; and a compensation unit configured to extract threshold voltage information of each driving transistor during a sensing period, wherein:

for each period, the compensation unit is configured to supply a preset voltage to the gate electrode such that a first current flows through the driving transistor during the sensing period, and to supply a reference voltage to the drain electrode during the sensing period in which the first current flows;

the reference voltage is produced when a second current flows through the organic light emitting diode;

the compensation unit is configured to control the voltage value of the preset voltage such that the second current is equal to the first current during the sensing period; and the organic light emitting display device is configured to change bits of data supplied from outside the organic light emitting display device based on the preset voltage at which the second current is equal to the first current.

2. The organic light emitting display device of claim 1, wherein the preset voltage at which the second current is equal to the first current is the threshold voltage information.

3. The organic light emitting display device of claim 1, wherein the compensation unit comprises:

a voltage control unit configured to supply the reference voltage and the preset voltage; and a current measurement unit configured to measure the first current and the second current.

4. The organic light emitting display device of claim 1, further comprising a timing controller configured to change bits of data supplied from outside the organic light emitting display, corresponding to the threshold voltage information, and transmit the changed bits to the data driver.

5. The organic light emitting display device of claim 1, further comprising:

emission control lines connected to the pixels and the scan driver; and a first power source to supply power to the organic light emitting diodes, wherein each pixel positioned on an i-th (i is a natural number) horizontal line comprises:

the organic light emitting diode;

the driving transistor configured to control the amount of current supplied from the first power source to the organic light emitting diode;

a first transistor connected between a specific data line and the gate electrode of the driving transistor, the first transistor being turned on when a scan signal is supplied to an i-th scan line;

a third transistor connected between the drain electrode of the driving transistor and an anode electrode of the organic light emitting diode, the third transistor being turned on when an emission control signal is supplied to an i-th emission control line, and turned off otherwise;

a fourth transistor connected between the drain electrode of the driving transistor and the specific data line, the fourth transistor being turned on when a control signal is supplied to an i-th control line; and a storage capacitor connected between the first power source and the gate electrode of the driving transistor.

6. A method of driving an organic light emitting display device, the method comprising:

applying a reference voltage to a drain electrode of a driving transistor so that a first current flows through an organic light emitting diode connected to the drain electrode of the driving transistor;

applying a preset voltage to a gate electrode of the driving transistor;

applying the reference voltage to the drain electrode of the driving transistor and measuring a second current flowing through the driving transistor corresponding to the preset voltage;

controlling the voltage value of the preset voltage so that the second current is set to the same current value as the first current; and changing bits of data supplied from outside the organic light emitting display device based on the preset voltage at which the second current is equal to the first current.

7. The method of claim 6, wherein the changing bits of data supplied from outside the organic light emitting display device comprises:

extracting the preset voltage of which the voltage value is controlled as threshold voltage information of the driving transistor; and controlling bits of data so that the threshold voltage of the driving transistor is compensated corresponding to the threshold voltage information.

8. An organic light emitting display device, comprising:

pixels arranged in an area defined by data lines, scan lines, and control lines, each pixel comprising an organic light emitting diode and a driving transistor;

a scan driver configured to drive the scan lines;

a data driver configured to drive the data lines;

a control line driver configured to drive the control lines;

a compensation unit configured to extract threshold voltage information of the driving transistor of each pixel during a sensing period; and a timing controller configured to control the scan driver, the data driver, the control line driver, and the compensation unit, wherein the compensation unit is configured to:

supply a preset voltage to a gate electrode of the driving transistor so that a first current flows during the sensing period;

supply a reference voltage to a drain electrode of the driving transistor during the period in which the first current flows; and control the voltage value of the preset voltage so that the second current is equal to the first current during the sensing period, and wherein the timing controller is configured to change bits of data supplied from outside the organic light emitting display device based on the preset voltage at which the second current is equal to the first current.

* * * * *